US010082146B2

(12) United States Patent
Okabe

(10) Patent No.: US 10,082,146 B2
(45) Date of Patent: Sep. 25, 2018

(54) BLOWER

(71) Applicant: DENSO CORPORATION, Kariya, Aichi-pref. (JP)

(72) Inventor: Souta Okabe, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 238 days.

(21) Appl. No.: 14/903,606

(22) PCT Filed: May 22, 2014

(86) PCT No.: PCT/JP2014/002696
§ 371 (c)(1),
(2) Date: Jan. 8, 2016

(87) PCT Pub. No.: WO2015/004836
PCT Pub. Date: Jan. 15, 2015

(65) Prior Publication Data

US 2016/0153460 A1 Jun. 2, 2016

(30) Foreign Application Priority Data

Jul. 11, 2013 (JP) ..... 2013-145684

(51) Int. Cl.
*F04D 25/06* (2006.01)
*F04D 17/16* (2006.01)
(Continued)

(52) U.S. Cl.
CPC ..... *F04D 25/06* (2013.01); *F04D 17/10* (2013.01); *F04D 17/16* (2013.01); *F04D 25/082* (2013.01);
(Continued)

(58) Field of Classification Search
CPC ..... F04D 17/00; F04D 25/06; F04D 25/082; F04D 29/083; F04D 29/282;
(Continued)

(56) References Cited

U.S. PATENT DOCUMENTS 4,092,556 A * 5/1978 Mabuchi ..... H02K 9/06 310/227
4,623,090 A * 11/1986 Heger ..... B60H 1/00471 236/49.1
(Continued)

FOREIGN PATENT DOCUMENTS

JP H10023700 A 1/1998
JP 2002048097 A 2/2002
(Continued)

OTHER PUBLICATIONS

International Search Report and Written Opinion (in Japanese with English Translation) for PCT/JP2014/002696, dated Aug. 12, 2014; ISA/JP.

*Primary Examiner* — Devon Kramer
*Assistant Examiner* — Joseph Herrmann
(74) *Attorney, Agent, or Firm* — Harness, Dickey & Pierce, P.L.C.

(57) ABSTRACT

A blower is designed such that a backflow of air from a ventilation path into a cooling-air exhaust path is prevented by a fan-side rib and an electric motor casing-side rib. The electric motor casing-side rib is formed on an external side of the fan in a fan radial direction such that a distance between the fan-side rib and the electric motor casing-side rib in the fan radial direction becomes long. Accordingly, a flow of an electric-motor cooling air is less disturbed, and the electric-motor cooling air can be secured sufficiently. As a result, an electric motor can be cooled sufficiently, an abrasion of a brush is restricted, and a copper powder of a
(Continued)

material making the brush is prevented from flowing into the ventilation path with the electric-motor cooling air.

16 Claims, 2 Drawing Sheets

(51) Int. Cl.
*F04D 25/08* (2006.01)
*F04D 29/28* (2006.01)
*F04D 29/42* (2006.01)
*F04D 29/08* (2006.01)
*F04D 17/10* (2006.01)

(52) U.S. Cl.
CPC ..... *F04D 29/083* (2013.01); *F04D 29/282* (2013.01); *F04D 29/4226* (2013.01)

(58) Field of Classification Search
CPC ..... F04D 29/4226; F04D 29/584; F04D 29/5806; F04D 29/40; F04D 17/10; H02K 5/10; H02K 5/20; H02K 9/00; H02K 9/005; H02K 9/02; H02K 9/06; H02K 9/08; H02K 9/10
USPC ..... 417/423.8, 423.1, 423.14; 310/52, 64, 310/58, 60 R, 61, 62, 89
See application file for complete search history.

(56) References Cited

U.S. PATENT DOCUMENTS

| | | | | |
|---|---|---|---|---|
| 4,866,320 | A * | 9/1989 | Schulz | F04D 25/082 310/227 |
| 5,955,803 | A * | 9/1999 | Gandhi | F04D 25/082 310/52 |
| 7,175,398 | B2 * | 2/2007 | Kinmartin | B60H 1/00471 310/89 |
| 2002/0025253 | A1 | 2/2002 | Ozeki et al. | |
| 2013/0121818 | A1 * | 5/2013 | Shichiken | F04D 29/162 415/204 |

FOREIGN PATENT DOCUMENTS

| | | | |
|---|---|---|---|
| JP | 2002161890 | A | 6/2002 |
| JP | 2008280928 | A | 11/2008 |
| JP | 2010059845 | A | 3/2010 |
| JP | 2012140884 | A | 7/2012 |

* cited by examiner

BLOWER

CROSS REFERENCE TO RELATED APPLICATIONS

This application is a U.S. National Phase Application under 35 U.S.C. 371 of International Application No. PCT/JP2014/002696 filed on May 22, 2014 and published in Japanese as WO 2015/004836 A1 on Jan. 15, 2015. This application is based on and claims the benefit of priority from Japanese Patent Application No. 2013-145684 filed on Jul. 11, 2013. The entire disclosures of all of the above applications are incorporated herein by reference.

TECHNICAL FIELD

The present disclosure relates to a blower that drives a fan, which generates an air flow, by an electric motor having a brush.

BACKGROUND ART

A blower for a vehicle air conditioner is known to cool an electric motor by introducing a part of air, which is to be blown into a vehicle compartment, to an inside of the electric motor as an electric-motor cooling air.

The electric-motor cooling air after passing inside of the electric motor returns to a ventilation path formed between a fan and an electric motor casing through a cooling-air exhaust path.

A backflow of air from the ventilation path to the cooling-air exhaust path is restricted by forming a fan-side rib in the fan to protrude toward the cooling-air exhaust path and by forming an electric motor casing-side rib in the electric motor casing to protrude toward the cooling-air exhaust path (refer Patent Literature 1).

PRIOR ART LITERATURES

Patent Literature

Patent Literature 1: JP 2002-48097 A

SUMMARY OF INVENTION

However, according to studies conducted by the inventor of the present disclosure, a distance between the fan-side rib and the electric motor casing-side rib in a flow direction of the electric-motor cooling air (i.e., in a fan radial direction) is short in a conventional blower. Accordingly, the electric-motor cooling air cannot be secured sufficiently since the fan-side rib and the electric motor casing-side rib disturb an air flow of the electric-motor cooling air.

Therefore, in the blower using the electric motor having a brush, the brush may be worn easily by an insufficient cooling, copper powder of a material making the brush may flow into the ventilation path with the electric-motor cooling air, and the copper powder may adhere to a mode door that is arranged on a downstream side of the blower.

A rubber part of members constituting a mode door is eroded by copper powder adhering thereto. There may be a measure to use a rubber material that is resistant to erosion caused by copper powder. However, such a rubber material is expensive.

The present disclosure addresses the above-described issues, and it is an objective of the present disclosure to provide a blower with which copper powder of a material making a brush is prevented from flowing into a ventilation path with an electric-motor cooling air.

To achieve the above objective, a blower of the present disclosure has an electric motor, a fan, a fan casing, and an electric motor casing. The fan has (i) blades arranged around a rotating shaft of the electric motor and (ii) a main plate that couples the blades and transmits a rotational driving force, which is generated by the electric motor, to the blades. The fan draws air from one side in an axial direction and blows the air outward in a fan radial direction. The fan casing houses the fan and forms a ventilation path for air that is blown into a vehicle compartment. The electric motor casing (i) therein forms a cooling-air introducing path that introduces a part of the air to an inside of the electric motor as an electric-motor cooling air and (ii) forms a cooling-air exhaust path, through which the electric-motor cooling air returns to the ventilation path, between the main plate. The main plate has a fan-side rib that is formed on a surface facing the electric motor casing and protrudes toward the cooling-air exhaust path. The electric motor casing has an electric motor casing-side rib that is formed on an external side of the fan in the fan radial direction and protrudes toward the cooling-air exhaust path. The electric motor casing-side rib may protrude in a direction that is opposite to a direction in which the fan-side rib protrudes.

Accordingly, by forming the electric motor casing-side rib on the external side of the fan in the fan radial direction, a distance between the fan-side rib and the electric motor casing-side rib in the fan radial direction is elongated. Therefore, a flow of the electric-motor cooling air is less disturbed, and the electric-motor cooling air can be secured sufficiently. As a result, an abrasion of the brush is suppressed, and copper powder of a material making the brush can be prevented from flowing into the ventilation path with the electric-motor cooling air.

DESCRIPTION OF EMBODIMENTS

An embodiment of the present disclosure will be described.

Figure 1:
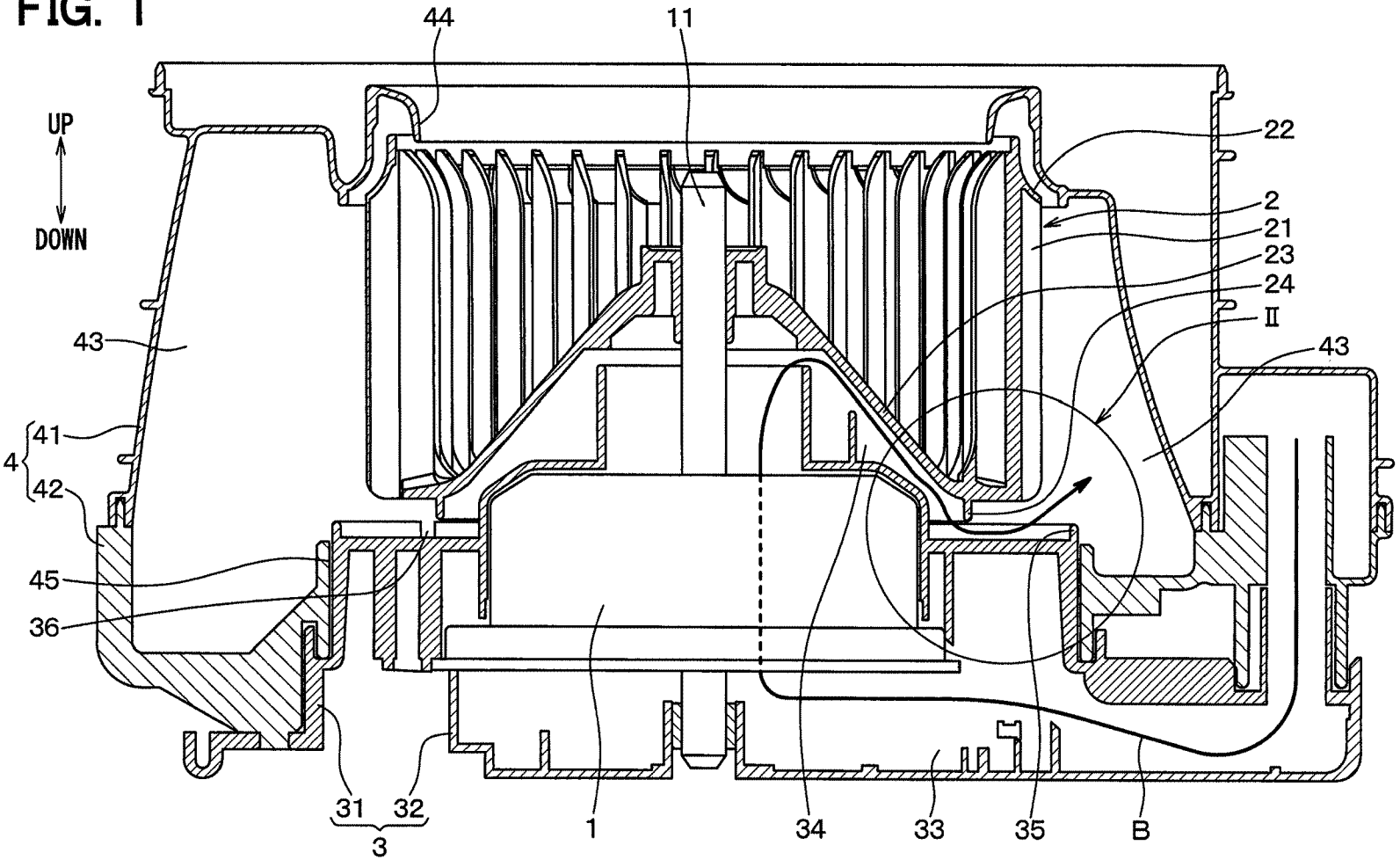
FIG. 1 is a sectional view illustrating a blower of an embodiment of the present disclosure.

As shown in FIG. 1, the blower has an electric motor 1, a fan 2, an electric motor casing 3, and a fan casing 4. The electric motor 1 has a brush made of copper. The fan 2 is made of resin and operated rotatably by the electric motor 1 to blow air. The electric motor casing 3 is made of resin and houses the electric motor 1. The fan casing 4 is made of resin and houses the fan 2. An axial direction of a rotating shaft 11 of the electric motor 1 will be referred to as a rotation axis direction.

The fan 2 has blades 21 that have a plate shape and are arranged around the rotating shaft 11. The blade 21 has one end portion on one side in the rotation axis direction, in other words, on a side adjacent to a suction port 44, and the one end portions of the blades 21 are coupled by an annular side plate 22. The blade 21 has the other end portion on the other side in the rotation axis direction, and the other end portions of the blades 21 are coupled by a main plate 23.

The main plate 23 has a generally conical shape that protrudes toward the one side in the rotating axis direction, in other words, to a side adjacent to the side plate 22. The main plate 23 is coupled with the rotating shaft 11 at a center portion thereof and transmits a rotational driving force generated by the electric motor 1 to the blades 21.

The fan 2 is operated rotatably by the electric motor 1, draws air from the one side in the rotation axis direction into the fan 2, and blows the air outward in a fan radial direction.

The electric motor casing 3 has a first electric motor casing 31 and a second electric motor casing 32. The electric motor casing 3 is branched from a ventilation path 43 that is described after. The electric motor casing 3 forms a cooling-air introducing path 33 that introduces a part of air into the electric motor 1 as an electric-motor cooling air. A cooling-air exhaust path 34, through which the electric-motor cooling air after passing inside of the electric motor 1 returns to the ventilation path 43, is formed between the first electric motor casing 31 and the main plate 23. An arrow B in FIG. 1 shows a flow of the electric-motor cooling air.

The fan casing 4 has a first fan casing 41 and a second fan casing 42. The fan casing 4 therein forms the ventilation path 43 in which air that is to be blown into a vehicle compartment flows. The suction port 44, which is an inlet through which air that is drawn by the fan 2 flows, is formed in the first fan casing 41 on the one side in the rotation axis direction. A fan-casing through hole 45, to which the first electric motor casing 31 fits, is formed in the second fan casing 42 at a position facing the suction port 44.

Figure 2:
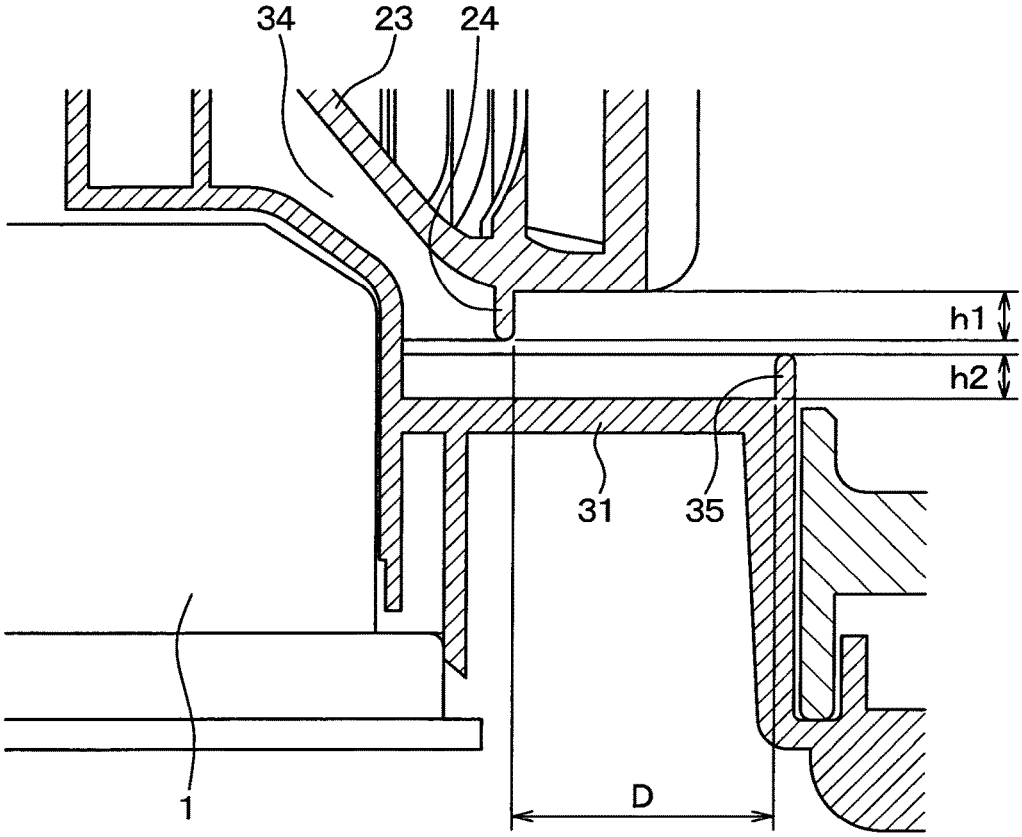
FIG. 2 is an enlarged sectional view of a portion II that is shown in FIG. 1.

As shown in FIG. 2, a fan-side rib 24 protruding toward the cooling-air exhaust path 34 is formed on a surface of the main plate 23 that faces the first electric motor casing 31. The fan-side rib 24 extends in the rotation axis direction and formed to have an annular shape along a fan circumferential direction.

An electric motor casing-side rib 35 protruding toward the cooling-air exhaust path 34 is formed in the first electric motor casing 31 on an external side of the fan 2 in the fan radial direction. The electric motor casing-side rib 35 may protrude in a direction that is opposite to a protruding direction of the fan-side rib 24. The electric motor casing-side rib 35 extends in the rotation axis direction and is formed to have an annular shape along the fan circumferential direction.

A backflow of air from the ventilation path 43 to the cooling-air exhaust path 34 is suppressed by the fan-side rib 24 and the electric motor casing-side rib 35.

As shown in FIG. 1, the electric motor casing-side rib 35 has a notch 36 partially in the fan circumferential direction such that the electric-motor cooling air easily returns to the ventilation path 43 from the cooling-air exhaust path 34. A quantity of the notch 36 may be one or may be more than or equal to two.

In a vehicle air conditioner, an inside-outside air switching case that is not shown is connected on an upstream side of the blower in an air flow direction, and an air conditioning unit that is not shown is connected on a downstream side of the blower in the air flow direction. In the air conditioning unit, an evaporator that cools air, a heater core that heats air, a mode door that sets a target to which air is blown, or the like are arranged. Air drawn by the fan 2 is ventilated to the air conditioning unit through the ventilation path 43, passes through the air conditioning unit, and is blown to each outlet located on a downstream end in the air flow direction.

The blower having the above-described configuration blows air to the air conditioning unit through the ventilation path 43 and introduces a part of air into the cooling-air introducing path 33 when the electric motor 1 operates the fan 2. The electric-motor cooling air, which is introduced into the cooling-air introducing path 33, cools the electric motor 1 when passing inside of the electric motor 1 and returns to the ventilation path 43 through the cooling-air exhaust path 34.

The electric motor casing-side rib 35 is formed on the external side of the fan 2 in the fan radial direction. Accordingly, a distance D between the fan-side rib 24 and the electric motor casing-side rib 35 in a flow direction of the electric-motor cooling air (i.e., in the fan radial direction) is elongated.

By elongating the distance D, a flow of the electric-motor cooling air is less disturbed, and the electric-motor cooling air can be secured sufficiently. As a result, an electric motor 1 can be cooled sufficiently, an abrasion of the brush is suppressed, and copper powder of a material making the brush is prevented from flowing into the ventilation path 43 with the electric-motor cooling air.

By setting a height h1 of the fan-side rib 24 and a height h2 of the electric motor casing-side rib 35 to avoid an overlap of the fan-side rib 24 with the electric motor casing-side rib 35 in the fan radial direction, the flow of the electric-motor cooling air is less disturbed, and the electric-motor cooling air can be secured more easily.

According to the present embodiment, since an inflow of copper powder into the ventilation path 43 can be suppressed, an erosion of a rubber part of the mode door can be suppressed, and thereby an expensive rubber material is not necessary.

Other Modifications

In the above-described embodiment, a filter may be disposed in a ventilation path extending from the cooling-air exhaust path 34 to the evaporator in the air conditioning unit such that the filter catches copper powder flowing out of the electric motor 1.

The electric-motor cooling air after passing inside of the electric motor 1 may be guided to return to the inside-outside air switching case such that a filter disposed in the inside-outside air switching case catches copper powder flowing out of the electric motor 1.

Although the electric motor casing-side rib 35 has the notch 36 in the above-described embodiment, the notch 36 may be omitted. That is, the electric motor casing-side rib 35 may have an annular shape having no break in the fan circumferential direction.

The present disclosure is not limited to the above-described embodiment and can be modified as required in a scope of the present disclosure.

In the above-described embodiments, it is to be understood that elements constituting the embodiment are not necessary except for a case of being explicitly specified to be necessary and a case of being considered to be absolutely necessary in principle.

Even when a factor such as a quantity of elements, a value, an amount, a range is mentioned in the above-described embodiment, it is to be understood that the factor is not limited to a specific value except for a case of being explicitly specified to be necessary and a case of being considered to be absolutely necessary in principle.

Even when a feature such as a material forming a member, a shape of a member, a positional relation of members, it is to be understood that such feature is not limited to a specific material, shape, positional relation, or the like except for a case of being explicitly specified to be necessary and a case of being considered to be absolutely necessary in principle.

What is claimed is:

1. A blower comprising:

an electric motor having a brush;

a fan that has (i) a plurality of blades arranged around a rotating shaft of the electric motor and (ii) a main plate that couples the plurality of blades and transmits a rotational driving force, which is generated by the electric motor, to the plurality of blades, the fan draws air from one side in an axial direction and blows the air outward in a fan radial direction;

a fan casing housing the fan and forming a ventilation path for the air blown into a vehicle compartment; and an electric motor casing that (i) therein forms a cooling-air introducing path introducing a part of the air to an inside of the electric motor as an electric-motor cooling air and (ii) forms a cooling-air exhaust path, through which the electric-motor cooling air returns to the ventilation path, between the electric motor casing and the main plate, wherein the main plate has a fan-side rib that is formed on a surface facing the electric motor casing and protrudes inside of the cooling-air exhaust path, wherein the fan-side rib is formed annularly along a fan circumferential direction, and wherein the electric motor casing has an electric motor casing-side rib that is formed on an external side of the fan in the fan radial direction and protrudes toward the cooling-air exhaust path.

2. The blower according to claim 1, wherein the fan-side, rib and the electric motor casing-side rib are set to have a height that avoids overlapping with each other in the fan radial direction.

3. The blower according to claim 1, wherein the electric motor casing-side rib is formed annularly along the fan circumferential direction.

4. The blower according to claim 3, wherein the electric motor casing-side rib has a notch partially in the fan circumferential direction.

5. The blower according to claim 1, wherein the fan further includes an annular side plate which couples the plurality of blades at a side opposite from the main plate, the annular side plate being located between the fan-side rib and the electric motor casing-side rib in the fan radial direction.

6. The blower according to claim 1, wherein the cooling-air introducing path is branched from the ventilation path, the cooling-air exhaust path is connected between the cooling-air introducing path and the ventilation path, and the electric motor casing-side rib protrudes inside of the ventilation path.

7. The blower according to claim 1, wherein the fan-side rib and the electric motor casing-side rib are separated by a predetermined elongated distance in the fan radial direction such that a flow of the electric-motor cooling air is not disturbed.

8. The blower according to claim 1, wherein a predetermined height of the fan-side rib and a predetermined height of the electric motor casing-side rib in the fan radial direction are set such that a flow of the electric-motor cooling air is not disturbed.

9. A blower comprising:

an electric motor having a brush;

a fan that has (i) a plurality of blades arranged around a rotating shaft of the electric motor and (ii) a main plate that couples the plurality of blades and transmits a rotational driving force generated by the electric motor to the plurality of blades, the fan draws air from one side in an axial direction and blows the air outward in a fan radial direction;

a fan casing housing the fan and forming a ventilation path for the air blown into a vehicle compartment; and an electric motor casing that (i) therein forms a cooling-air introducing path introducing a part of the air to an inside of the electric motor as an electric-motor cooling air and (ii) forms a cooling-air exhaust path, through which the electric-motor cooling air returns to the ventilation path, between the electric motor casing and the main plate, wherein the main plate has a fan-side rib that is formed on a surface facing the electric motor casing and protrudes inside of the cooling-air exhaust path, wherein the fan-side rib is formed annularly along a fan circumferential direction, and wherein the electric motor casing has an electric motor casing-side rib that is formed on an external side of the fan in the fan radial direction and protrudes in a direction that is opposite to a protruding direction in which the fan-side rib protrudes.

10. The blower according to claim 9, wherein the fan-side rib and the electric motor casing-side rib are set to have a height that avoids overlapping with each other in the fan radial direction.

11. The blower according to claim 2, wherein the electric motor casing-side rib is formed annularly along the fan circumferential direction.

12. The blower according to claim 11, wherein the electric motor casing-side rib has a notch partially in the fan circumferential direction.

13. The blower according to claim 9, wherein the fan further includes an annular side plate which couples the plurality of blades at a side opposite from the main plate, the annular side plate being located between the fan-side rib and the electric motor casing-side rib in the fan radial direction.

14. The blower according to claim 9, wherein the cooling-air introducing path is branched from the ventilation path, the cooling-air exhaust path is connected between the cooling-air introducing path and the ventilation path, and the electric motor casing-side rib protrudes inside of the ventilation path.

15. The blower according to claim 9, wherein the fan-side rib and the electric motor casing-side rib are separated by a predetermined elongated distance in the fan radial direction such that a flow of the electric-motor cooling air is not disturbed.

16. The blower according to claim 9, wherein a predetermined height of the fan-side rib and a predetermined height of the electric motor casing-side rib in the fan radial direction are set such that a flow of the electric-motor cooling air is not disturbed.

* * * * *